US005546096A

United States Patent [19]

Wada

[11] Patent Number: 5,546,096

[45] Date of Patent: Aug. 13, 1996

[54] TRAVELING-WAVE FEEDER TYPE COAXIAL SLOT ANTENNA

[75] Inventor: Koichi Wada, Saku, Japan

[73] Assignee: Beam Company Limited, Minamisaku-gun, Japan

[21] Appl. No.: 401,293

[22] Filed: Mar. 9, 1995

Related U.S. Application Data

[63] Continuation of Ser. No. 952,143, Sep. 28, 1992, abandoned, which is a continuation of Ser. No. 774,172, Oct. 15, 1991, abandoned, which is a continuation of Ser. No. 579,192, Sep. 7, 1990, abandoned, which is a continuation of Ser. No. 406,592, Sep. 13, 1989, abandoned.

[51] Int. Cl.$^6$ ..... H01Q 13/12

[52] U.S. Cl. ..... 343/771; 343/770

[58] Field of Search ..... 343/770, 771, 343/891, 756; H01Q 13/10, 13/12, 13/20, 13/22

[56] References Cited

U.S. PATENT DOCUMENTS

| | | | |
|---|---|---|---|
| 2,756,421 | 7/1956 | Harvey et al. | 343/770 |
| 2,774,068 | 12/1956 | Haagensen | 343/770 |
| 2,840,818 | 6/1958 | Reed et al. | 343/770 |
| 2,914,766 | 11/1959 | Butler | 343/771 |
| 2,934,762 | 4/1960 | Smedes | 343/756 |
| 3,106,713 | 10/1963 | Murata et al. | 343/770 |
| 3,377,596 | 4/1968 | Spitz | 343/771 |
| 3,417,400 | 12/1968 | Black | 343/771 |
| 3,524,189 | 8/1970 | Jones, Jr. | 343/771 |
| 3,560,970 | 2/1971 | Kamimura et al. | 343/771 |
| 3,696,433 | 10/1972 | Killion et al. | 343/770 |
| 3,963,999 | 6/1976 | Nakajima et al. | 343/771 |
| 4,243,990 | 1/1981 | Nemit et al. | 343/771 |

FOREIGN PATENT DOCUMENTS

| | | |
|---|---|---|
| 2123120 | 9/1972 | France . |
| 2315135 | 6/1976 | France . |
| 28 54 133 | 1/1979 | Germany . |
| 54-82539 | 11/1952 | Japan . |
| 49-2500 | 1/1974 | Japan . |
| 58-21849 | 5/1983 | Japan . |
| 59-108406 | 6/1984 | Japan . |
| 61-127203 | 6/1986 | Japan . |
| 62-20403 | 1/1987 | Japan . |
| 63-26112 | 2/1988 | Japan . |
| 64-73805 | 3/1989 | Japan . |
| 1179526 | 1/1970 | United Kingdom . |
| 1272878 | 5/1972 | United Kingdom . |
| 1452017 | 10/1976 | United Kingdom . |
| 1481485 | 7/1977 | United Kingdom . |
| 2031654 | 4/1980 | United Kingdom . |

OTHER PUBLICATIONS

J. Arnbak , Proceedings of the 1971 European Microwave Conference, vol. 1, pp. 5:1–5:4, Aug. 1971.

J. Grilo et al., 1989 International Symposium Digest Antennas and Propagation, vol. 1, pp. 286–289, Jun. 1989.

*Primary Examiner*—Michael C. Wimer
*Attorney, Agent, or Firm*—Foley & Lardner

[57] ABSTRACT

A traveling-wave feeder type coaxial slot antenna, comprising: a central conductor extending over a certain length; a cylindrical outer conductor coaxially surrounding the central conductor; and a plurality of slots provided in the outer conductor at a certain inclination angle, for instance 45 degrees, relative to a longitudinal axis of the outer conductor. This antenna can be conveniently fabricated from a commercially available coaxial cable. By suitable selection of the inclination angle of the slots and their mutual spacing, the antenna may be provided with a directivity directed to a desired elevation angle when mounted on a vertical wall to make is suitable for receiving radio wave signals from a satellite.

15 Claims, 16 Drawing Sheets

FIG. 14a
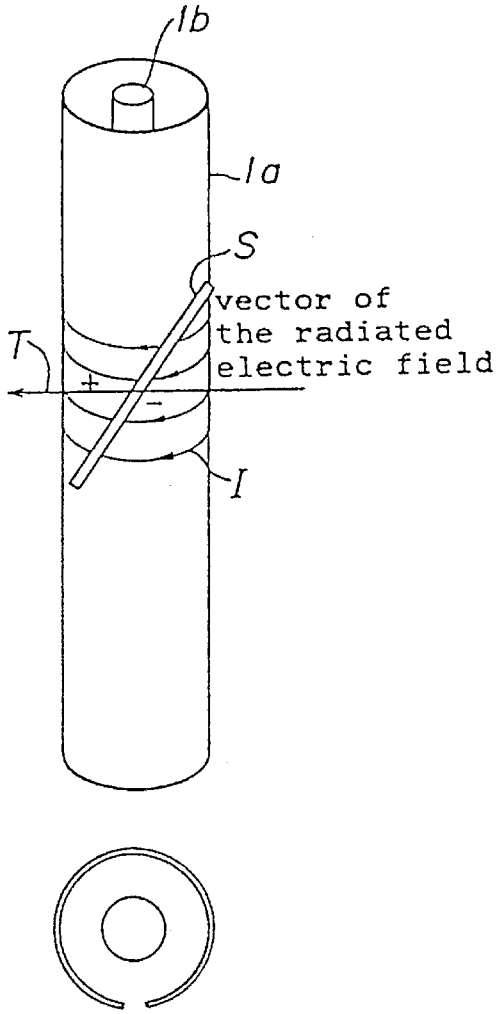
FIG. 14b
FIG. 15a
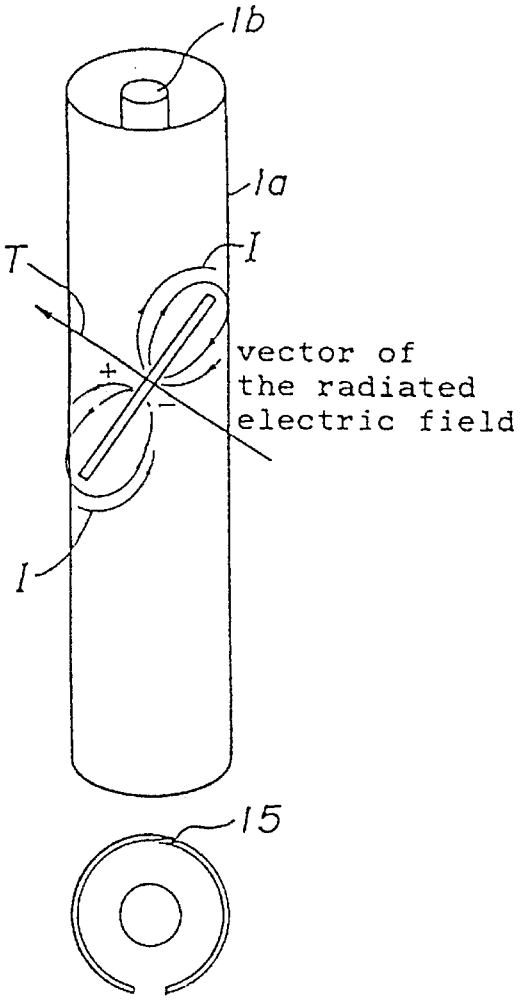
FIG. 15b

TRAVELING-WAVE FEEDER TYPE COAXIAL SLOT ANTENNA

This application is a continuation of application Ser. No. 07/952,143, filed Sep. 28, 1992, now abandoned, which is a continuation of U.S. application Ser. No. 07/774,172 filed Oct. 15, 1991 now abandoned; which is a continuation of Ser. No. 07/579,192 filed Sep. 7, 1990 now abandoned; which is a continuation of Ser. No. 07/406,592 filed Sep. 13, 1989 now abandoned.

TECHNICAL FIELD

The present invention relates to coaxial slot antennas based on a traveling-wave feeder system which are suitable for use in satellite broadcasting, satellite communication, and radar, and antenna arrays for transmitting and receiving radio waves using a plurality of such antennas.

BACKGROUND OF THE INVENTION

Satellite broadcasting and satellite communication require antennas having high gains. Such high gains are made possible through sharp directivities, and such directivities have been considered to be possible only with such antennas as parabolic antennas. However, in order to receive radio wave signals from a satellite 36,000 km above the equator, the parabolic antennas have to have large surface areas, and they are required to be directed exactly to the satellite. Therefore, large dishes are required to ensure large surface areas, and large mechanical structures are required to keep the antennas stationary even when they are subjected to strong winds. Furthermore, they must be installed so as to be exactly directed to the satellite. For these reasons, various difficulties arise when such antennas are to be installed at homes.

Recently, there have been proposed various planar antennas using a large number of antenna elements on a single plane. From electromagnetic view point, such planar antennas are equivalent to parabolic antennas. However, according to such an antenna, its major beam is perpendicular to its major surface and, if it is simply mounted flat on a vertical wall, its beam is directed horizontally. It is therefore desired to tilt the main beam by the elevation angle of a satellite in view of ease of mounting the antenna, but such attempts have not been successful due to various problems involved in fabrication. Furthermore, a planar antenna comprises a large number of antenna elements, and a considerable loss is inevitable in collecting signals from the antenna elements. As antennas for radar, waveguide slot antennas are widely used but are too expensive for consumer use.

The theories for coaxial feeder lines have been known from the past, and have been applied to various products. The inventor is not aware of any attempt to produce a beam antenna by opening a large number of slots each having a length for resonance in a coaxial transmission line and slanted by a suitable angle relative to the longitudinal axis of the coaxial transmission line. If such an attempt were made in low frequency ranges far below the cutoff frequency of a particular coaxial cable where such coaxial cables are typically used, the length of the slots would become so long that they become spiral, and such an antenna would be quite unusable. Further, it has been common to use a waveguide and it has been inconceivable to use a coaxial cable in certain high frequency ranges.

For instance, when 12 GHz is selected for a satellite broadcast frequency, its space wave length will be $\lambda_0$=25 mm, and the resonance length of the slot will be $\lambda_0/2$=12.5 mm (in reality the resonance length will be slightly shorter than this). As it is possible to conduct 12 GHz radio wave signal with a coaxial cable whose outer conductor has an inner diameter of 10 mm (or an inner circumferential length of 31.4 mm), it is possible to form a slot antenna with this coaxial cable by opening slots having a length in the order of 10 mm at desired interval. Such coaxial cables using outer conductors which are approximately 10 mm in inner diameter are commercially available for use in VHF and UHF frequency bands. They are also used for CATV because of their favorable handling.

Since the outer conductors have small thicknesses and the underlying insulators serve as a support for cutting slots out of the outer conductor, fabrication of such a slot antenna is extremely simple. This slot antenna has the additional advantage of economy because the coaxial cables are being mass produced, and are inexpensive.

A waveguide has a higher transmission efficiency than a coaxial cable in high frequency ranges for satellite broadcasting and radar, but the transmission efficiency is not a significant problem when a coaxial cable is used as a slot antenna as its length is quite small, and the use of a coaxial cable offers advantages of economy and simplicity which far outweigh a slight loss in transmission efficiency.

As there had been no attempt to use a coaxial cable in frequency ranges near its cutoff frequency, various potential problems existed, but, since handling of high frequency signals with coaxial cables has been common in the field of measuring instruments, there were no insurmountable problems. However, it should be understood that the use of a coaxial cable is solely based on commercial availability and economy, and that forming a coaxial transmission line by rolling sheet metal is also included in the concept of the present invention.

Such a coaxial slot antenna can be used as an individual antenna, but may also be used as a primary radiation source to increase its aperture area and, hence, its gain.

It is extremely difficult to aim a high directivity antenna to a satellite which is not visible to naked eyes. However, since this slot antenna may be fabricated so as to have a directivity having a proper angle of elevation when it is mounted on a vertical wall, all that is required in installing this antenna is to adjust its azimuth angle or its bearing. This is a significant advantage over other antennas which require adjustment of both the elevation angle and the azimuth angle on installing them.

A similar slot antenna is used for telephone communication with trains (refer to Japanese patent publication No. 58-21849), but, as this antenna is intended only for short-distance communication, the length of the slots are far shorter than the resonance length and composition of directivity or polarization property of the transmitted radio wave is not considered to be important.

BRIEF SUMMARY OF THE INVENTION

In view of such problems of the prior art, a primary object of the present invention is to provide a slot antenna based on a traveling-wave feeder system which is easy to install.

A second object of the present invention is to provide an economical antenna having a high directivity which makes it suitable for use in high frequency communication such as satellite broadcasting.

A third object of the present invention is to provided a traveling-wave feeder type slot antenna demonstrating a favorable property in composing directivity and a favorable wave polarization property.

A fourth object of the present invention is to provide an improved method for transmitting and receiving high-frequency radio wave using such an antenna.

These and other objects of the present invention can be accomplished by providing a traveling-wave feeder type coaxial slot antenna, comprising: a central conductor extending over a certain length; a cylindrical outer conductor coaxially surrounding the central conductor; and a plurality of slots provided in the outer conductor at a certain inclination angle relative to a longitudinal axis of the outer conductor. Because a sharp directivity and a favorable wave polarization property can be obtained simply by adjusting the inclination angle and the spacing of the slots, the coaxial slot antenna of the present invention can be conveniently used as a high-performance and easy handling antenna for satellite broadcasting, satellite communication and radar. As this antenna can be fabricated as a planar and vertically elongated antenna, it can be conveniently mounted on a vertical wall. A desired directivity to a certain elevation angle can be given to the antenna, as it is mounted on a vertical wall, by suitable selection of the inclination angle and the spacing of the slots. Furthermore, the antenna may be fabricated as having a relatively large length so that it may be cut to a desired length upon installation so that the problems of stocking a large number of such antennas of different dimensions for different applications can be avoided.

Improvements in directivity and gain may be effected by using this antenna in combination with a parabolic reflector and/or by using an array of such coaxial slot antennas arranged in mutually parallel relationship in combination with a waveguide mixing circuit which is commonly connected to output ends of the coaxial slot antennas.

According to another preferred embodiment of the present invention, radiated power from each of the slots is controlled by adjusting the inclination angle and the length of the slot in the vicinity of a resonance point, and the inner diameter D of the outer conductor satisfies the following conditions:

$$\frac{\lambda_0}{2\pi}\sin\theta_{MAX} < D < \frac{2}{\pi\left(1+e^{\frac{-Z_0\sqrt{\epsilon_r}}{60}}\right)} \times \frac{V_0}{\sqrt{\epsilon_r}\, f}$$

where $\epsilon_r$ is the relative dielectric constant of an insulator separating the central conductor from the outer conductor, f is the transmission frequency, $Z_0$ is a characteristic impedance, $V_0$ is the space speed of radio wave, $\lambda_0$ is the wave length in the space, and $\theta_{MAX}$ is the maximum inclination angle of the slots relative to a longitudinal line of the outer conductor.

In the case of the double row system which is referred to in the disclosure, the inner diameter D of the outer conductor satisfies the following conditions:

$$\left(\frac{\lambda_0}{2}\sin\theta_{MAX} + Y\right)/\pi <$$

-continued $$D < \frac{2}{\pi\left(1+e^{\frac{-Z_0\sqrt{\epsilon_r}}{60}}\right)} \times \frac{V_0}{\sqrt{\epsilon_r}\, f}$$

where Y is the spacing between the two longitudinal center lines X1—X1 and X2—X2 of the two rows of the slots.

BRIEF DESCRIPTION OF THE DRAWINGS

Now the present invention is described in the following in terms of specific embodiments with reference to the appended drawings, in which:

FIGS. 14*a* and 14*b*, 15*a* and 15*b* and 16 are diagrams showing the patterns of electric current flow around the slots of the coaxial slot antenna;

DETAILED DESCRIPTION OF THE PREFERRED EMBODIMENTS

Figure 1:
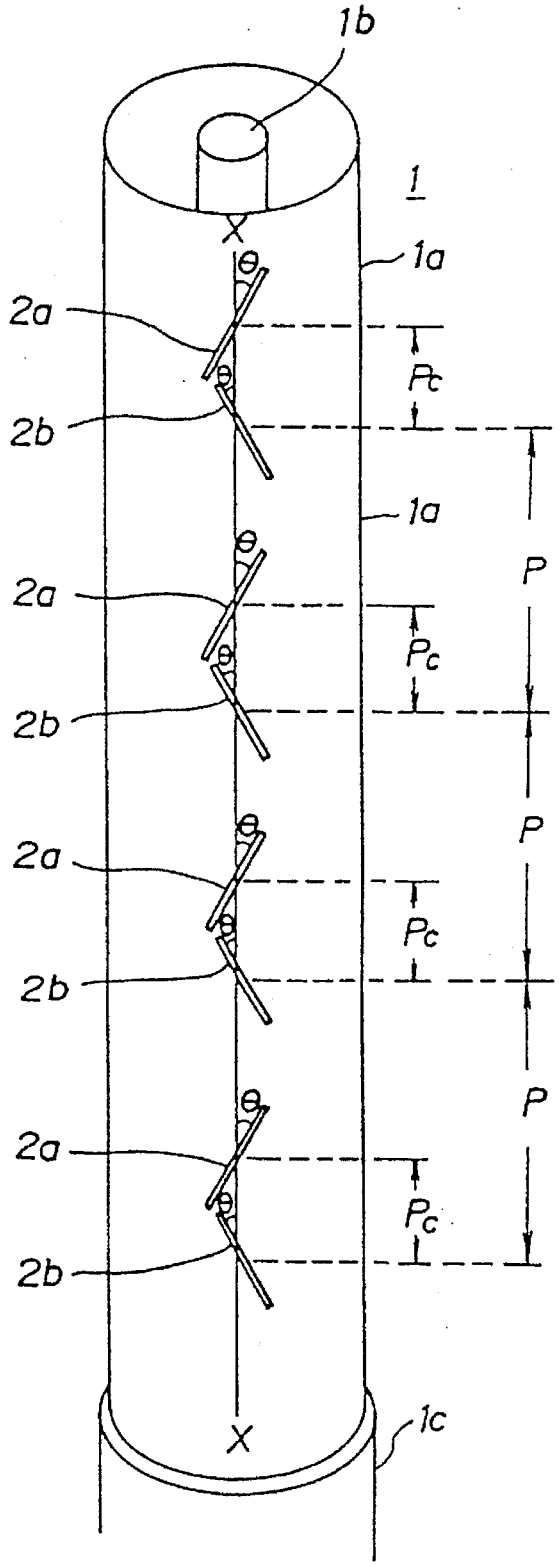
FIG. 1 is a perspective view of a first embodiment of the traveling-wave feeder type coaxial slot antenna according to the present invention.

FIG. 1 shows a first embodiment of the coaxial slot antenna according to the present invention. This coaxial slot antenna comprises a cylindrical outer conductor 1*a*, a central conductor 1*b* received centrally therein, and an outer sheath 1*c*, and a plurality of pairs of slots 2*a* and 2*b* are provided at equal interval along an axial line X—X or a generatrix of the outer conductor 1*a* in two rows. The slots 2*a* and 2*b* in each pair define angles +θ and −θ relative to the longitudinal line X—X, respectively, and the pairs are arranged along the longitudinal line X—X at the pitch of P so that a desired directivity and wave polarization property may be obtained. It should be understood, however, that the pitch P may be preferred to be uneven depending on the optimum design of the main beam which is desired for each particular application.

The configuration and the arrangement of these slots 2*a* and 2*b* provided in the outer conductor 1*a* are important factors in determining the properties of the antenna; the elevation angle of the radio wave transmission from the slot antenna when it is mounted on a vertical wall is determined by the pitch P of the slot pairs and the wave polarization property is determined by the spacing and the angles of the slots 2*a* and 2*b*. Also important is the degree of coupling between the slots and the transmission line. In short, to obtain an optimum performance from this coaxial slot antenna, it is important to achieve an optimum matching between the properties of this slot antenna as a feeder and as an antenna.

The degree of coupling between the antenna and the feeder can be controlled by adjusting the length of the slots 2*a* and 2*b* in relation with the resonance length and/or by changing the angle θ.

It is possible, as a special case, to transmit (or receive) a circular polarized wave by selecting the inclination angles of the slots 2*a* and 2*b* as ±45 degrees to make the polarization planes of the electric fields radiated from these slots 2*a* and 2*b* define a 90 degree angle, and adjusting the pitch P so as to achieve a phase difference of 90 degrees between the electric fields produced from these slots 2*a* and 2*b*.

Figure 2:
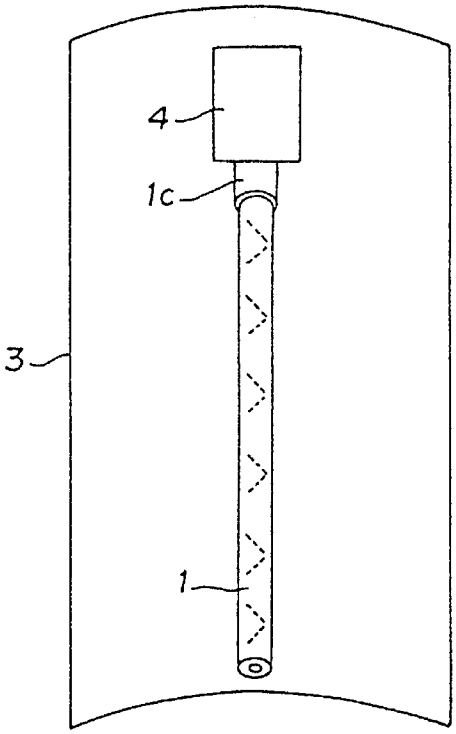
FIG. 2 shows a coaxial slot antenna according to the present invention combined with a parabolic reflector.

In the embodiment illustrated in FIG. 2, a parabolic reflector 3 is combined with a coaxial slot antenna 1 according to the present invention. The slots 2*a* and 2*b* of the coaxial slot antenna 1 face the parabolic reflector 3, and the output end of the slot antenna 1 provided in its upper end is connected to a transmitter/receiver (or to a converter, in the case of satellite broadcast) 4.

Figure 3:
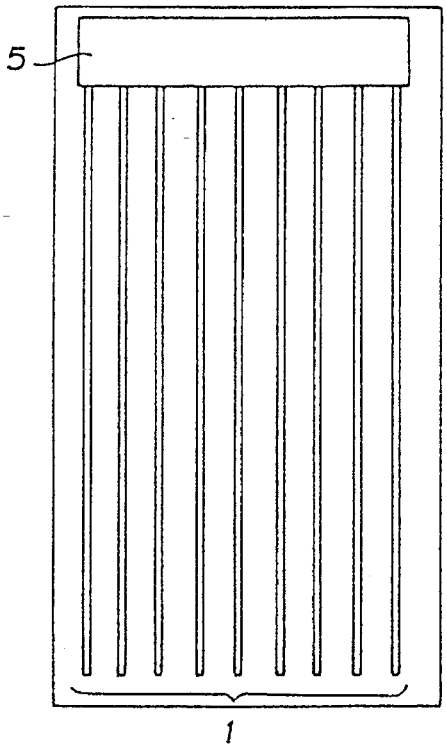
FIG. 3 is a front view of an array of mutually parallel coaxial slot antennas which are commonly connected to a mixing circuit at their output ends.
Figure 4:
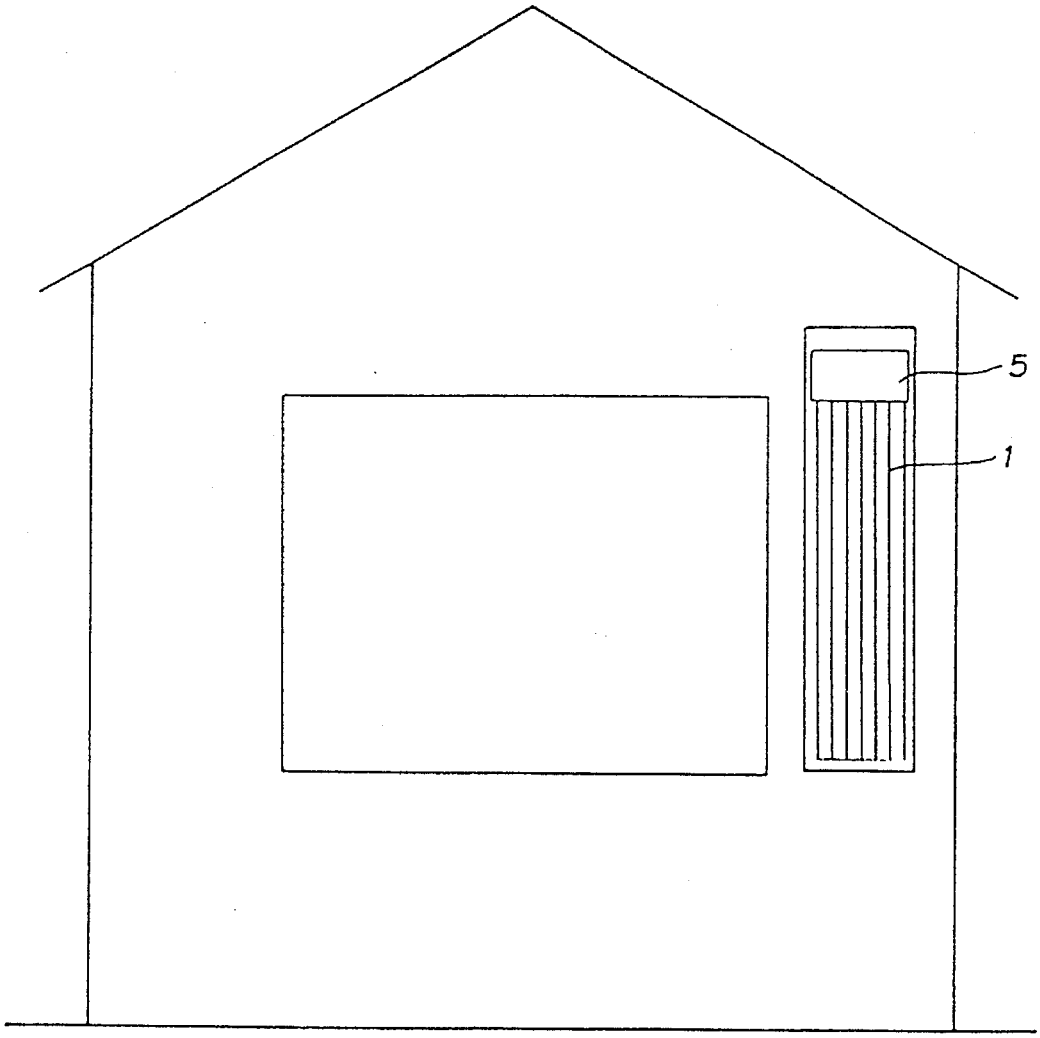
FIG. 4 is a schematic front view showing how the antenna array illustrated in FIG. 3 may be mounted on an outer vertical wall of a house.

In the embodiment illustrated in FIG. 3, a plurality of coaxial slot antennas 1 according to the present invention are arranged in mutually parallel relationship, and the output ends of the coaxial slot antennas 1 are connected to a mixing circuit and a transmitter/receiver 5. FIG. 4 illustrates how this antenna array 1 may be mounted on a vertical wall of a house.

Figure 7:
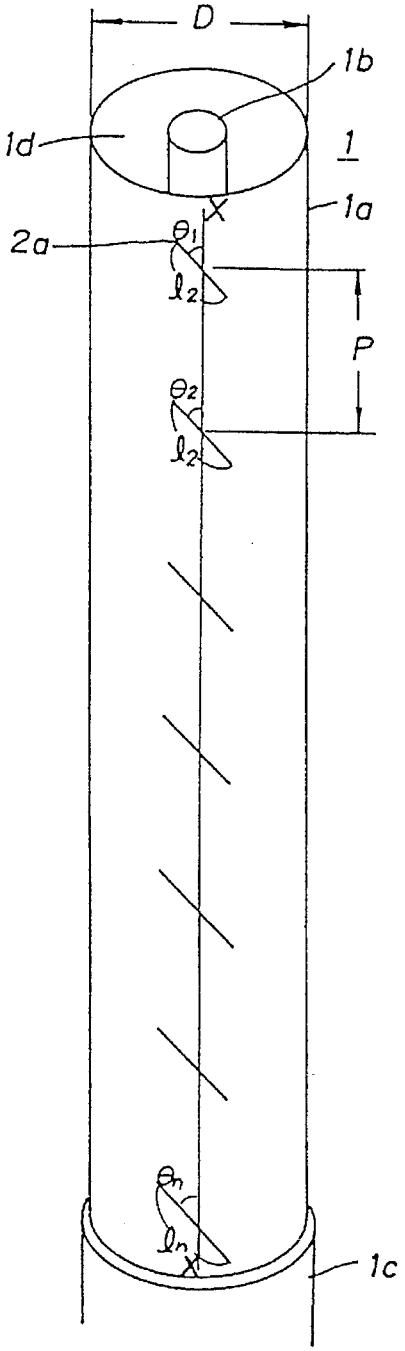
FIGS. 7 and 8 are perspective views showing a single row system coaxial slot antenna and a double row system coaxial slot antenna according to the present invention, respectively.
Figure 8:
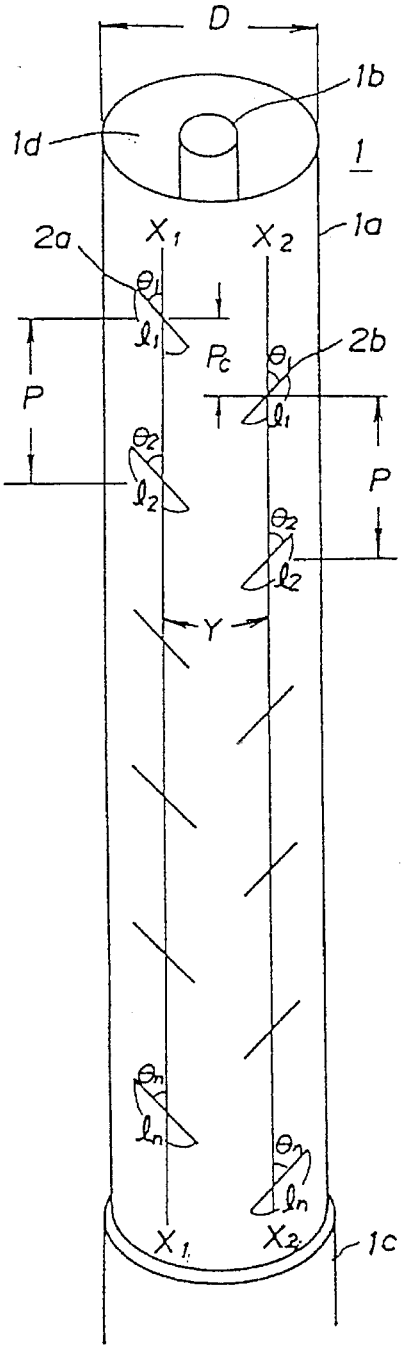

Thus, the coaxial slot antenna of the present invention may be used individually as illustrated in FIGS. 1, 7 and 8, or in combination with a parabolic reflector for added directivity. It is also possible to use a plurality of such coaxial slot antennas to obtain a desired directivity and a favorable wave polarization property. In particular, when an antenna is to be mounted on a vertical wall, it is preferred that the antenna is elongated along the vertical direction in view of efficient utilization of the wall surface area and the simplicity of installation. The coaxial slot antenna is quite suitable to be formed into an elongated antenna array, and it is also possible to fabricate antenna arrays having a relatively large length and to adjust the length as required immediately before installing them.

Figure 5:
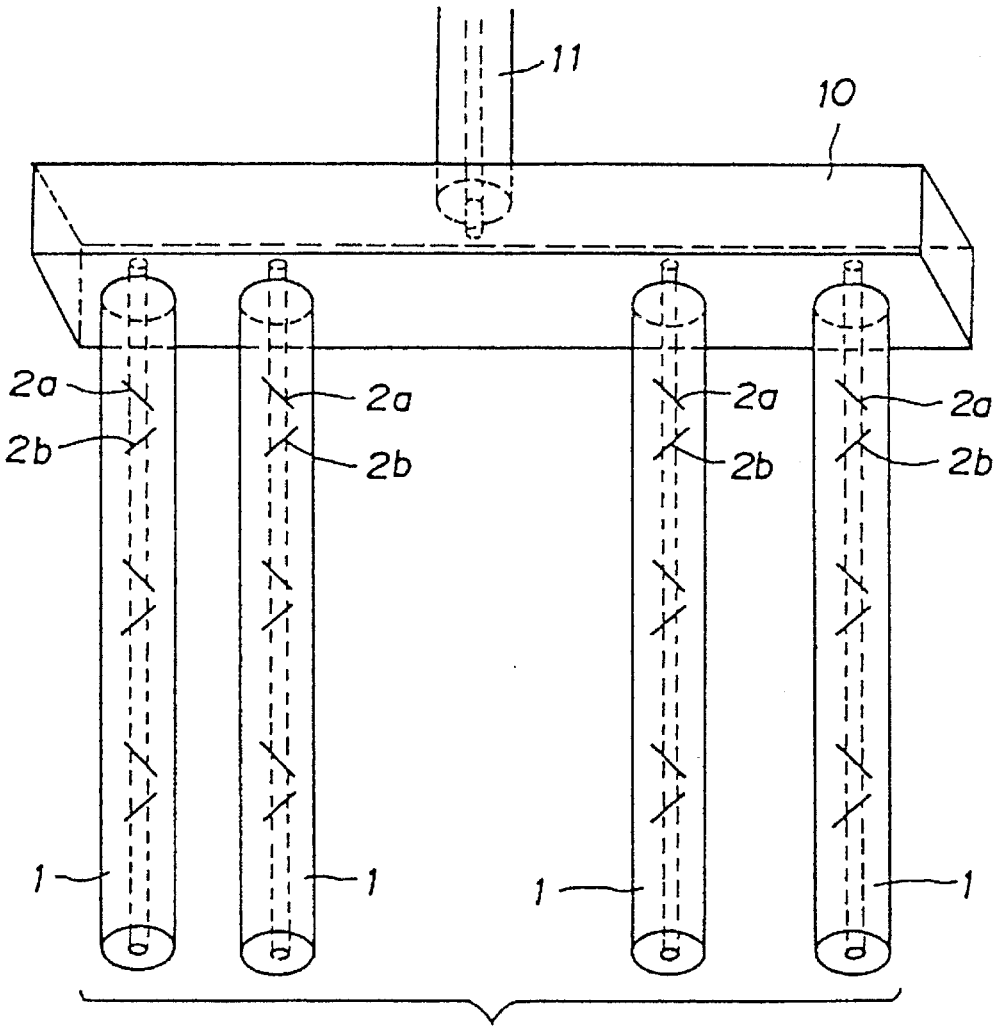
FIG. 5 schematically illustrates how a mixing circuit may be commonly connected to a plurality of coaxial slot antennas.

FIG. 5 shows a waveguide mixing circuit 10 which is connected to end portions of a plurality of coaxial slot antennas 1. A feeder cable 11 leading to a transmitter/receiver (not shown in the drawing) is coupled with a middle part of this mixing circuit 10. For low frequency ranges, the mixing circuit typically consists of a printed circuit board carrying various inductive and capacitive elements, but such a mixing circuit based on discrete elements and/or distributed elements becomes unusable in high frequency ranges (GHz bands) for satellite broadcasting, satellite communication and radar because stray capacitance and inductance would be significant. In microwave ranges or higher frequency ranges, waveguides are commonly used. Typically, a waveguide system and a coaxial cable system are coupled to each other via a transducer.

According to the present invention, a plurality of coaxial slot antennas are connected to a common waveguide mixing circuit. This ensures a high efficiency to this coaxial slot antenna array. It should be understood that the phase relationship in the waveguide, and the degree of coupling between the waveguide and the coaxial slot antennas must be appropriately adjusted.

Figure 6A:
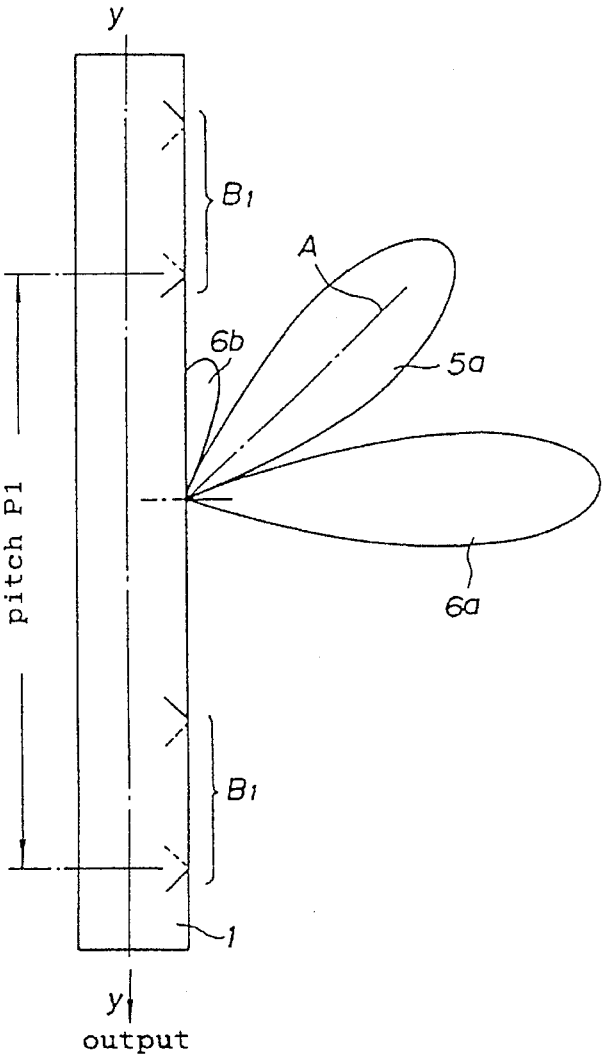
FIGS. 6*a* and 6*b* illustrate the differences in the generated main lobes and sub lobes depending on the location of the output ends.

The direction of the main beam from the coaxial antenna is determined by the phase of the traveling-wave in the coaxial transmission line and the positions of the slots. Referring to FIG. 6*a*, when the main beam is directed to oncoming radio wave, if the output end of the coaxial slot antenna is provided at its lower end, the optimum pitch P1 of the slots becomes longer and the gain drops due to the generation of sub lobes. On the other hand, if the output end of the coaxial slot antenna is provided at its upper end as illustrated in FIG. 6*b*, the optimum pitch P2 becomes shorter, and, as the sub lobes become extremely small, a sufficient gain can be obtained.

In other words, when the main beam 5*a* or 5*b* is trained upon the direction of oncoming radio wave, it defines an obtuse angle relative to the lower part of the coaxial slot antenna but defines an acute angle relative to the upper part of the coaxial slot antenna. Therefore, in the case illustrated in FIG. 6*a*, since the output of the coaxial slot antenna is taken out from its lower end, an obtuse angle is defined between the output end of the coaxial slot antenna and the main beam, and the pitch P1 of the slots is relatively large. As a result, large sub lobes 6*a* and 6*b* are produced, and the gain at the output end is reduced.

Figure 6B:
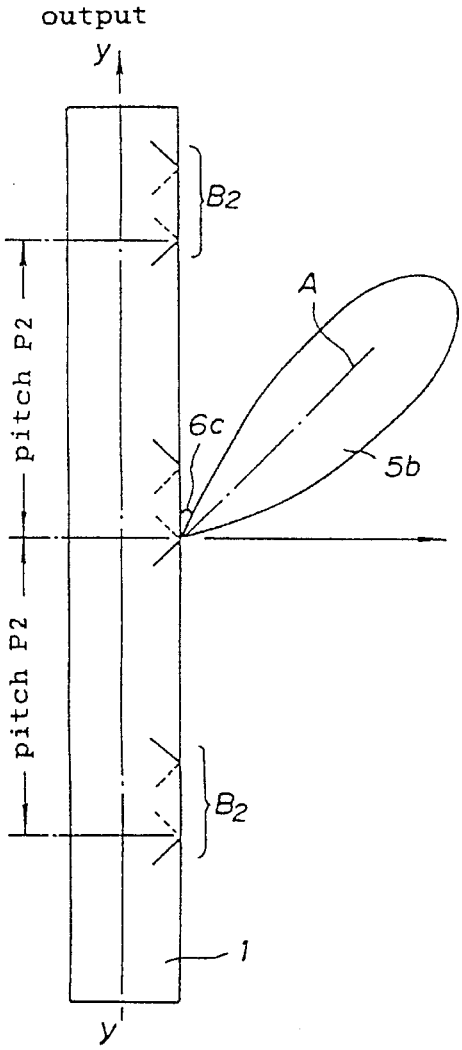

On the other hand, when the output is taken out from the upper end of the coaxial slot antenna 1 as shown in FIG. 6*b*, an acute angle is defined between the output end of the coaxial slot antenna and its main beam, and the pitch P2 of the slots is relatively small. As a result, only a very small sub lobe 6*c* is produced, and the gain at the output end is increased. B1 and B2 are provided so as to receive circular polarized radio wave of a specific direction (clockwise or counter-clockwise).

FIG. 7 illustrates yet another embodiment of the present invention which is similar to the embodiment illustrated in FIG. 1. This coaxial slot antenna comprises a cylindrical outer conductor 1*a*, a central conductor 1*b* and an outer sheath 1*c*. In this case, slots 2*a* have varying inclination angles relative to the longitudinal line X—X, but are all inclined in the same direction. In the embodiment illustrated in FIG. 8, two rows of slots 2*a* and 2*b* are provided along a pair of longitudinal lines X1—X1 and X2—X2. The slots of each row are inclined in the same direction but varying angles relative to the corresponding longitudinal line X1—X1 or X2—X2. The slots belonging to the different rows are slanted in opposite directions, but their absolute values of their inclination angles are matched between those laterally opposing each other with a certain offset Pc from the different rows. The inclination angles which are varied along the longitudinal direction are determined so as to achieve a desired distribution (for instance, a uniform distribution) of power radiation along the longitudinal direction of the coaxial slot antenna.

Hereinafter, the embodiment illustrated in FIG. 7 is called as a single row system while the embodiment illustrated in FIG. 8 is called as a double row system.

In the case of the single row system, the slots 2*a* are arranged at the pitch of P along the longitudinal line X—X. In the case of the double row system, the slots 2*a* and 2*b* are arranged along the respective longitudinal lines X1—X1 and X2—X2, and the offsetting between the slots 2*a* and 2*b* belonging to the different rows is Pc. The spacing between the two longitudinal lines X1—X1 and X2—X2 is Y.

Figure 9:
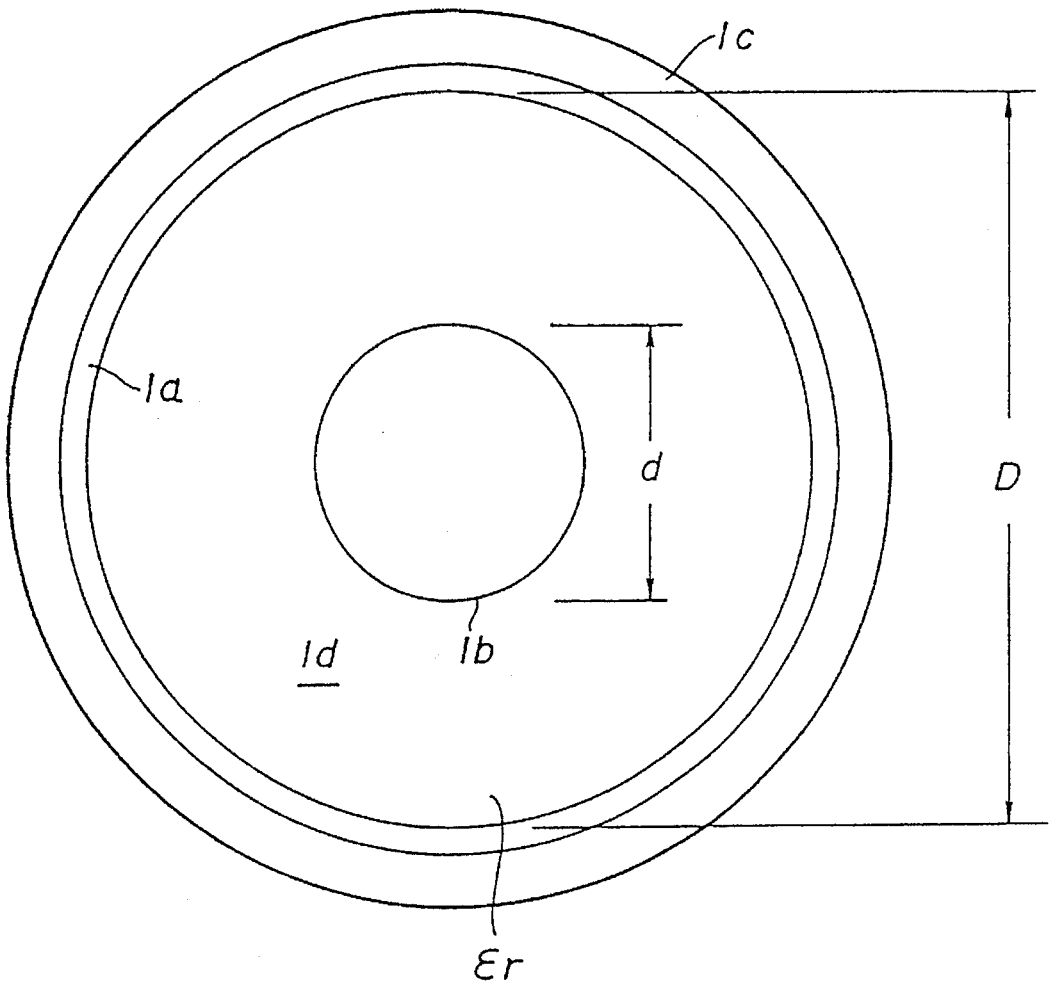
FIG. 9 is a cross-sectional view of the coaxial slot antenna.

In other words, in regards to the coaxial cable illustrated in FIG. 9, when the inner diameter of the outer conductor 1*a* is D, the outer diameter of the central conductor 1*b* is d, and the relative dielectric constant of the insulator 1*d* is $\epsilon_r$, and the traveling speed of light in free space is $V_0$, the relationship between the radio wave transmission frequency f and the wave length $\lambda_g$ in the transmission line is given by the following equation.

$$\lambda g = V_0/f\sqrt{\epsilon_r} \tag{1}$$

The lower limit of the wave length which the coaxial cable can transmit by the TEM mode is given by the following.

$$\lambda c \approx \pi(D + d)/2 \tag{2}$$

where $\lambda_c$ is the cutoff wave length.

Thus, the cutoff frequency corresponding to this cut-off wave length $\lambda_c$ is given by the following.

$$fc \approx V_0/\lambda c\sqrt{\epsilon_r} \tag{3}$$

It means that the coaxial cable cannot transmit radio waves of higher frequency than this limit in the TEM mode. In other words, there is a cutoff frequency 71 which is unique to each coaxial cable of given dimensions, and the thicker the cable is the lower the cutoff frequency becomes. Conversely, if a transmission frequency is given, there is a limit to the dimensions of the coaxial cable that can be used.

Normally, a coaxial cable is used for radio wave frequencies which are far lower than its cutoff frequency, and no such considerations are necessary, but a coaxial cable for transmitting extremely high frequency radio waves such as those for satellite broadcasting (11.7 GHz to 12.04 Ghz) must have an outer conductor whose outer diameter is no more than 10 to 15 mm. On the other hand, in order to open slots of a required length in the outer conductor 1*a* to use the coaxial cable as a coaxial slot antenna according to the present invention as shown in FIG. 9, the inner diameter of the outer conductor must have a sufficient value.

Each slot must be slanted with respect to the longitudinal line of the coaxial cable by a certain angle. This angle achieves the coupling between the slots and the coaxial cable that is required for radiation of radio wave, and the maximum radiation occurs when the length of each slot coincides with a certain resonance length.

To form an antenna array by opening a large number of slots in the outer conductor, the degree of coupling must be adjusted by changing the length of the slots and their inclination angle so that a desired antenna aperture value may be obtained. When the free space wave length of the radio wave is $\lambda_0$, the actual resonance length is slightly lower than $\lambda_0/2$, but using $\lambda_0/2$ for the resonance frequency is sufficient for most practical purpose.

As for the angle θ, it was found by experiments that cable attenuation by each resonant slot having the inclination angle θ=45 degrees was approximately 1 dB, and it was thus determined that 45 degrees is the inclination angle at which the maximum radiation occurs since the cable attenuation gives a good indication of the magnitude of power radiation from each slot.

The degree of coupling between the slots and the transmission line must be determined according to the desired radiation directivity and wave polarization properties. Generally speaking, the coupling must be closer as the slot is further away from the input end to achieve a uniform distribution of the power radiated from the antenna along its length. Therefore, it is necessary to use a cable whose diameter is large enough to ensure the length and inclination angle of the slot which requires the maximum degree of coupling in the particular antenna system. When this maximum inclination angle is given by $\theta_{MAX}$, the conditions for accommodating the resonance slots of this maximum inclination angle $\theta_{MAX}$ within the circumferential length of the outer conductor are given by:

$$D > \frac{\lambda_0}{2\pi} \sin \theta_{MAX} \tag{4}$$

in the case of the single row system, and by:

$$D > \left( \frac{\lambda_0}{2} \sin \theta_{MAX} + Y \right) / \pi \tag{5}$$

in the case of the double row system. Here, Y is the spacing between the two longitudinal lines X1—X1 and X2—X2 which is required for permitting the opening of the slots 2*a* along the longitudinal line X1—X1 and the slots 2*b* along the longitudinal line X2—X2, respectively, and, at the same time, contributes to the improvement of the wave polarization property of the slots. When Y=0, equation (5) degenerates into equation (4) for the single row system.

The conditions given by equations (4) and (5) give the minimum theoretical dimensions. In reality, a certain spacing is required between adjacent slots in order to ensure mechanical integrity and stability of the outer conductor, and the coaxial cable is desired to be thicker than the one given by equation (4) or (5) to avoid electric interferences.

The slots may take various forms other than simple rectangular or track shapes, such as wavy line shapes, dumb bell shapes, L shapes, crank shapes, cross shapes, swastika shapes (inverted or non-inverted), and so on. In any case, these variations of slot configurations reduce the required linear length of the slots, equations (4) and (5) should be understand that they are applicable to linear slots and some modifications are anticipated for slots of other configurations.

Figure 10:
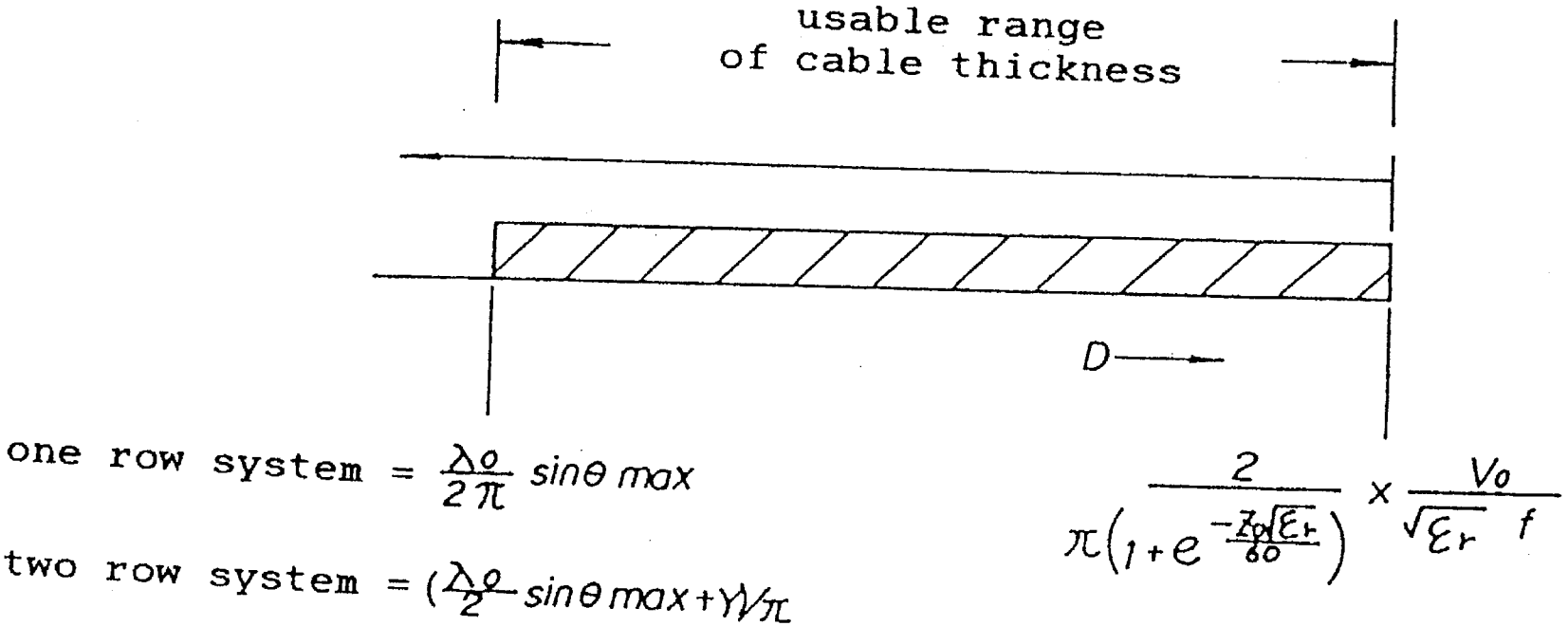
FIG. 10 illustrates the factors limiting the diameter of the outer conductor.

Now, as shown in FIG. 10, the inner diameter D of the outer conductor 1*a* is required to be intermediate between the maximum value imposed by the transmission mode and the minimum value required for opening required slots, and must satisfy the following equation.

$$D < \frac{2}{\pi\left(1+e^{\frac{-Z_0\sqrt{\epsilon_r}}{60}}\right)} \times \frac{V_0}{\sqrt{\epsilon_r}\, f} \tag{6}$$

Meanwhile, the conditions that the slots having a resonance length and the maximum inclination angle $\theta_{MAX}$ can be accommodated in the circumferential length ($\pi$D) of the outer conductor is given by equation (4) or by $$D > \frac{\lambda_0}{2\pi} \sin\theta_{MAX}$$

in the case of the single row system, and by equation (5) or by $$D > \left(\frac{\lambda_0}{2} \sin\theta_{MAX} + Y\right)/\pi$$

in the case of the double row system.

When typical wave lengths for satellite broadcasting are substituted into these equations, it can be seen that the inner diameter of the outer conductor should be in the range of a few millimeters to fifteen or so millimeters which happen to be the dimensions of mass produced and commercially available coaxial cables. Therefore, the coaxial slot antenna of the present invention has the advantage that an inexpensive coaxial cable can be readily converted into a coaxial slot antenna without requiring full-scale production facilities.

Figure 11:
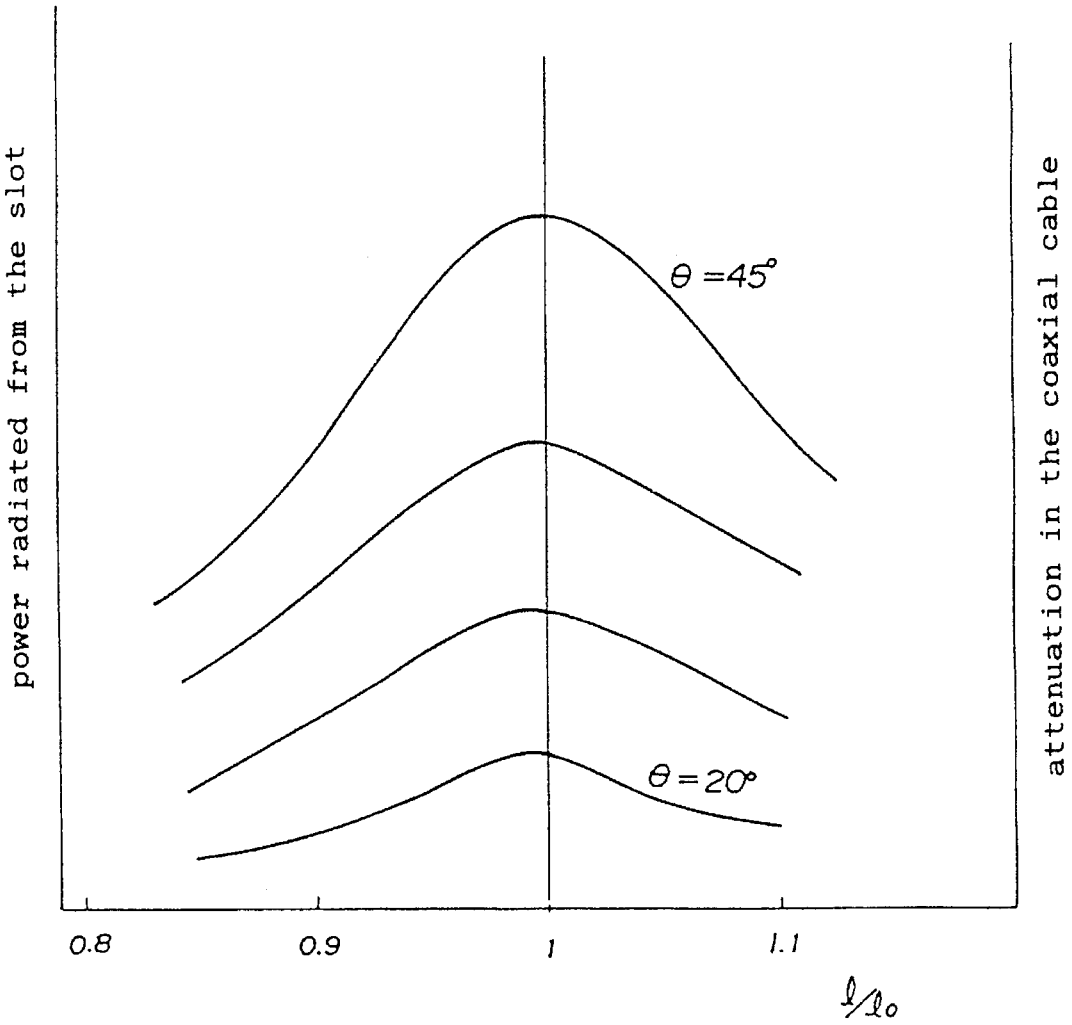
FIG. 11 is a graph showing the relationship between the radiated power from the slots and their length for different values of the inclination angle of the slots.

FIG. 11 is a graph showing the relationship between the radiated power and the deviation from the resonance length $l_0$ for different inclination angles $\theta$. From this graph, it can be seen that the radiated power must be appropriately controlled so as to effectively utilize the aperture and obtain a desired directivity as an antenna system. It was found by experiments that the slot length must be close to the resonance length for satisfactory composition of directivity. Thus, the degree of coupling between the slot and the transmission line must be controlled by proper selection of the inclination angle $\theta$ and the slot length so as to effectively utilize the aperture of the antenna system.

Figure 12:
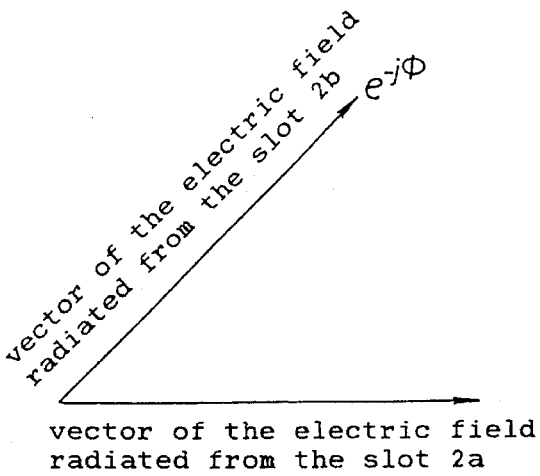
FIG. 12 schematically illustrates how a desired wave polarization property may be obtained by combining the electric fields produced by each slot pair.

FIG. 12 shows the vectors of the electric fields radiated from the slots 2*a* and 2*b* and their phase difference $\phi$; the emitted radio wave consists of a circular polarized wave when the radiated electric fields define a 90 degree angle therebetween and the phase difference is 90 degrees, and a linear polarized wave when the radiated electric fields define a 180 degree angle therebetween and the phase difference is 180 degrees. The wave polarization property of the radiated radio wave can be controlled by adjusting the spacing Y between the two longitudinal lines X1—X1 and X2—X2 and the offsetting $P_c$ between the slots 2*a* and 2*b* belonging to the two different rows.

Figure 13:
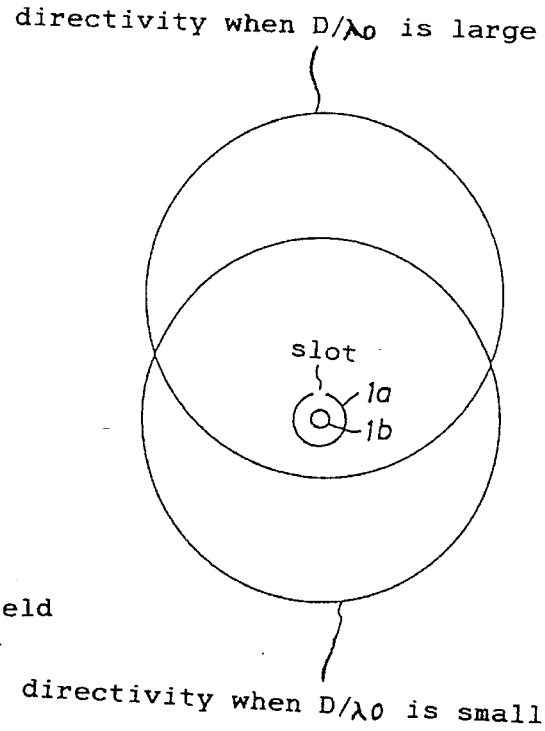
FIG. 13 schematically illustrates the relationship between the diameter of the outer conductor and the directivity of the radiated power.

FIG. 13 schematically illustrates that even when the inner diameter of the outer conductor satisfies the conditions given by equations (4) through (6), if the diameter D is small in comparison with the wave length, the slot antenna tends to have a reduced directivity, but, if the diameter is large in comparison with the wave length, a large portion of the power is radiated from the side where the slots are located, and a relatively small power is radiated from the opposite side of the coaxial slot antenna. When the antenna is used for radio wave reception, a higher directivity is preferred so as to achieve a high gain, and in particular a large F/B ratio is desired. Therefore, it is preferred in most cases to select as large a value as possible insofar as capable of achieving a TEM transmission for the inner diameter of the outer conductor.

Also, the quality factor value Q which concerns with the reception bandwidth becomes smaller as the inner diameter D is increased according to the experiments conducted by the inventor. In other words, the dimension of the coaxial slot antenna should be selected according to the directivity and the Q value which are desired to be achieved.

FIGS. 14*a* and 14*b*, 15*a* and 15*b* and 16 show the radiated electric fields produced from the slot S. Referring to FIGS. 14*a* and 14*b*, when the diameter of the coaxial cable is small in comparison with the wave length, and the impedance to the electric current directed circumferentially around the outer conductor S is lower than the impedance to the electric current surrounding the slot S, a majority of the electric current I flows circumferentially around the outer conductor and the resulting electric field T coincides with a plane perpendicular to the longitudinal axis of the coaxial cable as shown in FIG. 14*a*. In other words, the wave polarization plane is always perpendicular to the longitudinal axis of the coaxial cable irrespective of the inclination angle of the slot, thereby making it unusable for an antenna for a desired polarized radio wave.

When the outer conductor 1*a* is divided in a rear part thereof with respect to the slot, and the divided part 15 is insulated from each other by an insulator as shown in FIGS. 15*a* and 15*b*, a TEM transmission mode is achieved in the coaxial cable, and the impedance to the circumferential electric current due to the electromotive force induced by the slot S becomes high.

Figure 16:
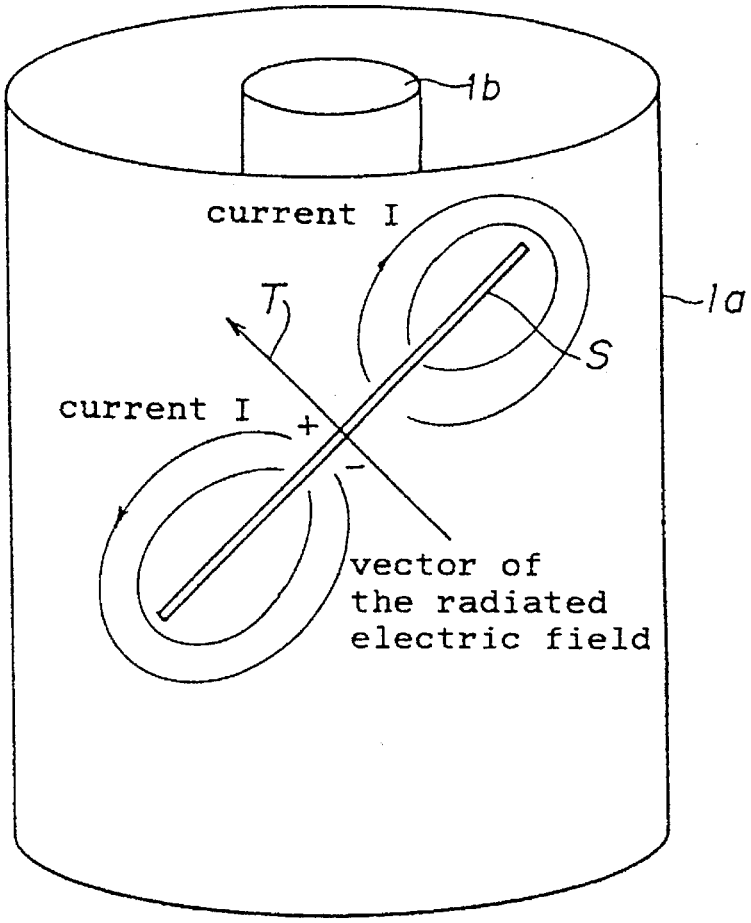

In other words, the diameter of the coaxial cable is desired to be as thick as possible insofar as a TEM mode can be achieved as shown in FIG. 16, and the circumferential electric current can be substantially reduced if the rear part of the outer conductor with respect to the slot is provided with a gap which is electrically insulated as shown in FIG. 15.

Figure 17:
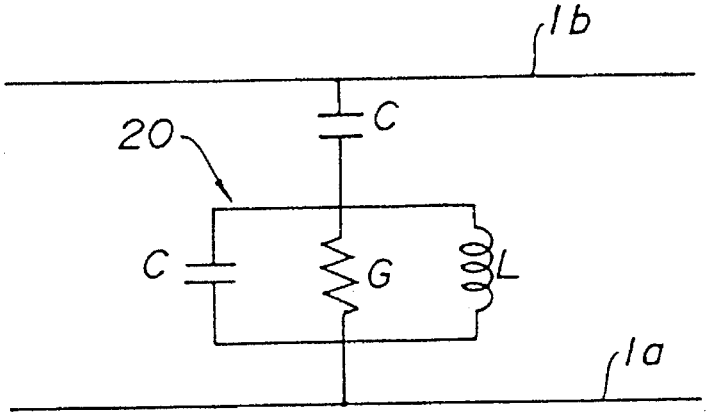
FIG. 17 is an equivalent circuit of the phase compensation circuit which is interposed between the central conductor and the outer conductor of the coaxial slot antenna of the present invention.
Figure 17A:
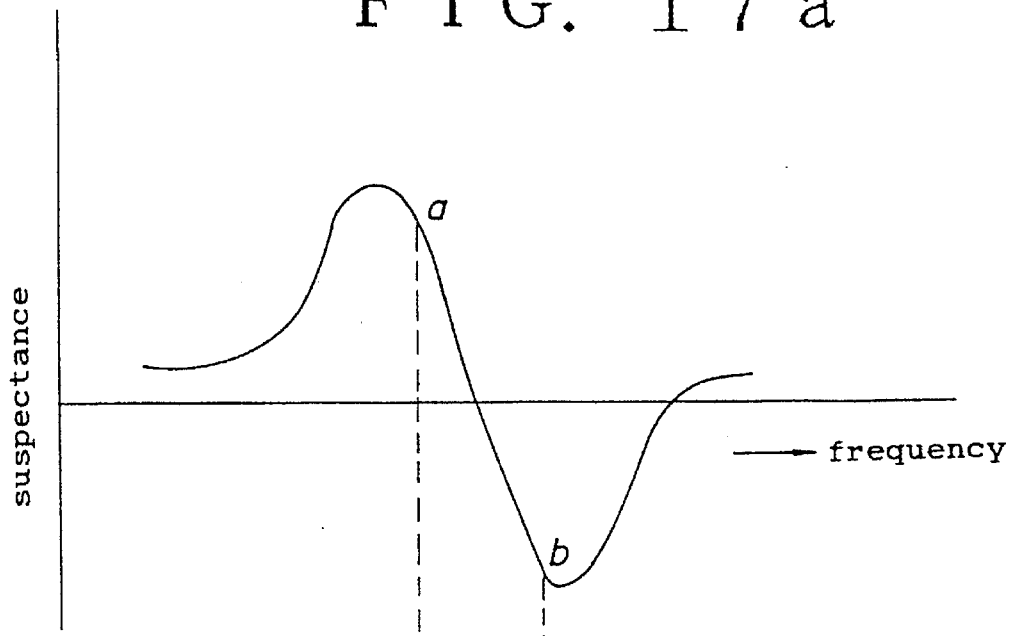
FIG. 17*a* is a graph showing the relationship between the frequency and the susceptance.
Figure 17B:
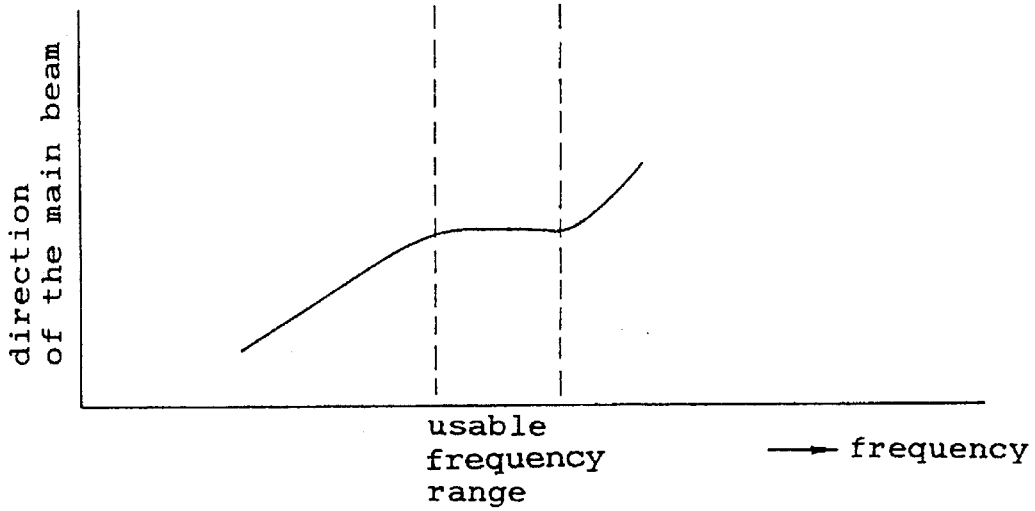
FIG. 17*b* is a graph showing the relationship between the direction of the main beam and the frequency.

In a traveling-wave feeder type slot antenna, the direction of its main beam changes according to the transmission phase in the coaxial cable and the pitch of the slots. The pitch of the slots is physically fixed and cannot be changed after the coaxial slot antenna has been fabricated, but the transmission frequency has a certain band width and the transmission phase in the cable changes according to the frequency. On the other hand, the direction of the main beam must be fixed in regards to a particular frequency band. To compensate for the phase, it is necessary to provide a phase compensation circuit 20, for instance as shown in FIG. 17, at suitable locations along the transmission line. A phase compensation effect can be produced by various resonance elements, but its basic equivalent circuit may be given as illustrated in FIG. 17. FIG. 17*a* shows the susceptance of this circuit in relation with frequency, and the phase of the signal in the transmission line can be compensated for by using an interval a–b which declines with increasing frequency. As a result, the direction of the main beam is fixed in the desired frequency band as shown in FIG. 17*b*.

Figure 18:
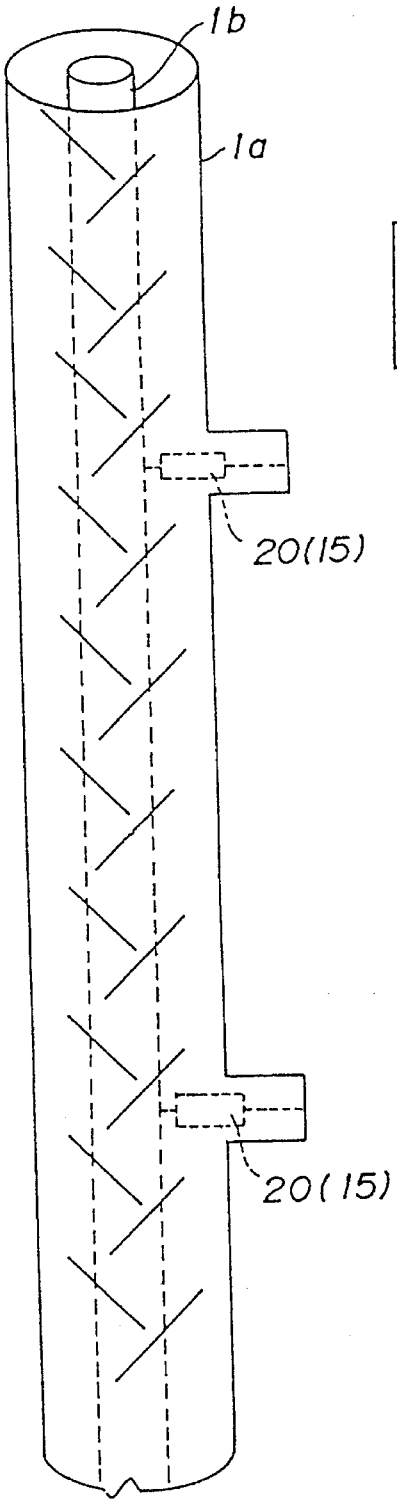
FIG. 18 shows another embodiment of the coaxial slot antenna provided with phase compensation circuits between its central conductor and outer conductor.

Such a phase compensation circuit 20 may be applied to the coaxial slot antenna of the present invention, for instance, by interposing a metallic rod 20 (corresponding to the phase compensation circuit 20) between the central conductor 1*b* and the outer conductor 1*a* at suitable locations as shown in FIG. 18.

Figure 19:
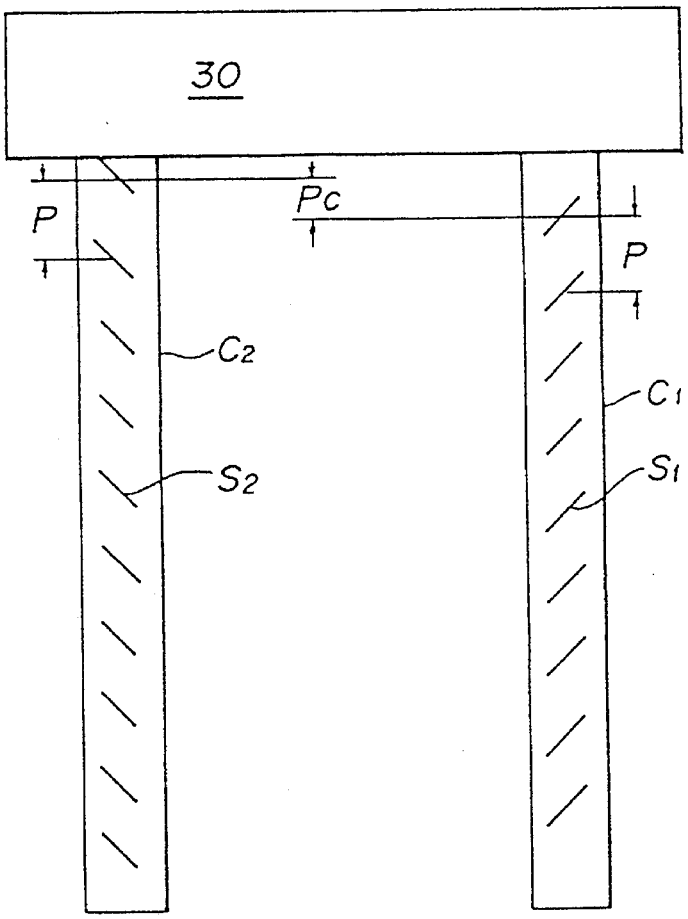
FIG. 19 schematically shows yet another embodiment of the coaxial slot antenna of the present invention.

In the embodiment illustrated in FIG. 19, a plurality of slots S1 having an inclination angle of θ are provided along a longitudinal line of a coaxial cable C1, and slots S2 having an inclination angle −θ are provided along a longitudinal line of another coaxial cable C2 extending in parallel with the aforementioned coaxial cable C1, the second mentioned slots S2 corresponding to the first mentioned slots S1 one-to-one but with a certain offsetting Pc so that a desired wave polarization property may be attained. The upper ends or the output ends of the coaxial cables C1 and C2 are connected to a mixing circuit 30 so as to achieve a high gain.

Figure 20:
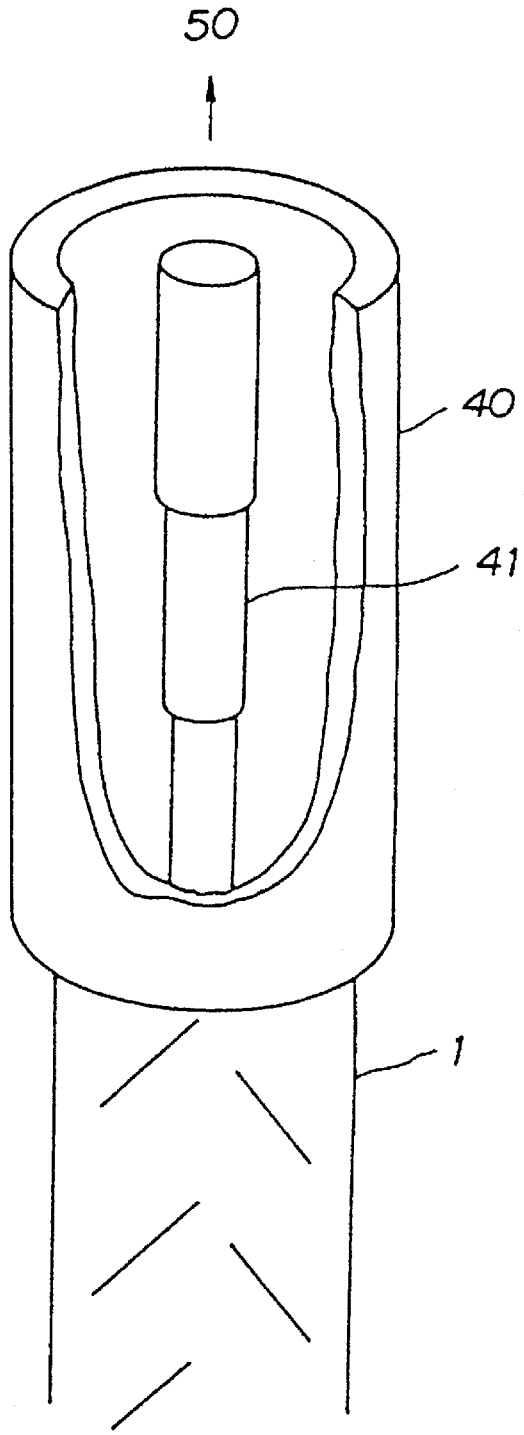
FIG. 20 is a partly broken away perspective view of a connector for the output end of a coaxial slot antenna incorporated with a transformer for impedance matching.

In the embodiment illustrated in FIG. 20, a coaxial slot antenna 1 and a transmitter/receiver 50 are connected to each other via a connector 40 which includes a transformer 41 for impedance matching. This transformer 41 may be realized by changing the diameter of the central conductor over a certain section thereof. In the frequency range for satellite broadcasting, since a quarter wave length is in the order of 6 mm, the transformer 41 may be easily accommodated in the connector 40.

Figure 21:
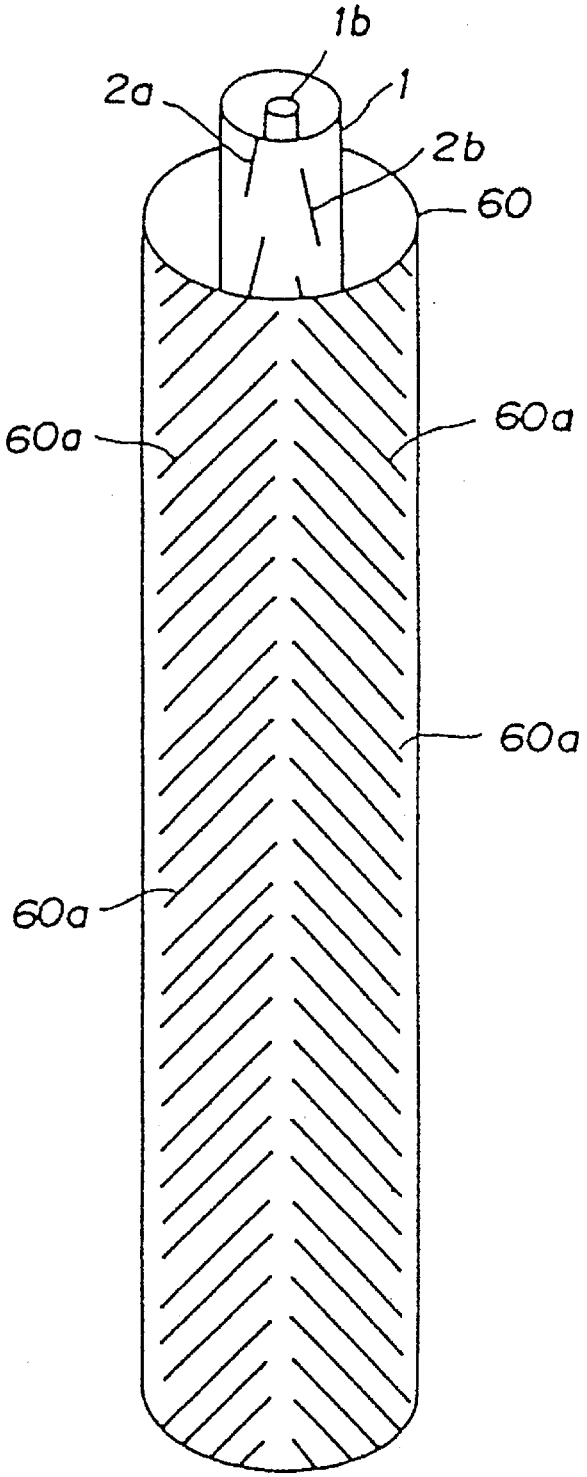
FIG. 21 is a perspective view of a screen for altering the wave polarization property of the coaxial slot antenna which maybe used in combination with the coaxial slot antenna of the present invention.

The degree of coupling between the transmission line and the slots 2*a* and 2*b* of the coaxial cable 1 is determined by their length and inclination angle, but may be determined independently from the polarization angle of the radio wave. To achieve a desired wave polarization property, it is possible to change the polarization plane of the radiated radio wave by external means. For instance, in the embodiment illustrated in FIG. 21, a screen 60 consisting of a metallic cylinder provided with a number of slots 60*a* is placed coaxially on the outer circumference of the coaxial slot antenna 1. As the screen 60 can change the polarization angle of the radiated radio wave, it is possible to obtain a desired wave polarization property by combining such a screen with a coaxial slot antenna 1.

Although the present invention has been shown and described with respect to detailed embodiments, it should be understood by those skilled in the art that various changes and omission in form and detail may be made therein without departing from the spirit or scope of this invention.

What we claim is:

1. A travelling-wave feeder type coaxial slot antenna, comprising:

a central conductor;

a cylindrical outer conductor coaxially surrounding the central conductor;

an insulator separating the central conductor from the outer conductor; and a plurality of slots provided in the outer conductor, each of the slots extending at an angle relative to a longitudinal axis of the outer conductor so as to obtain a desired directivity and wave polarizations;

wherein the inner diameter D of the outer conductor satisfies the following conditions:

$$\frac{\lambda_0}{2\pi}\sin\theta_{max} < D < \frac{2}{\pi\left(1+e^{\frac{-Z_0\sqrt{\epsilon_r}}{60}}\right)} \times \frac{V_0}{\sqrt{\epsilon_r}\, f}$$

wherein ε r is the relative dielectric constant of the insulator separating said central conductor from said outer conductor, $f$ is the transmission frequency and is greater than 1 GHz, $Z_0$ is a characteristic impedance of the antenna, $V_0$ is the free space velocity of a radio wave generated from the slots, $\lambda_0$ is the wave length in free space of the radio wave generated from the slots, and $\theta_{MAX}$ is the maximum angle of said slots relative to the longitudinal axis of said outer conductor.

2. A coaxial slot antenna according to claim 1, wherein two rows of slots are provided in the outer conductor, the rows extending parallel to the longitudinal axis of the outer conductor, and the inner diameter D of the outer conductor satisfies the following conditions:

$$\left(\frac{\lambda_0}{2\pi}\sin\theta_{max} + Y\right)/\pi <$$

$$D < \frac{2}{\pi\left(1+e^{\frac{-Z_0\sqrt{\epsilon_r}}{60}}\right)} \times \frac{V_0}{\sqrt{\epsilon_r}\, f}$$

where Y is the spacing between center lines passing through the two rows of slots; ε r is the relative dielectric constant of the insulator separating said central conductor from said outer conductor, $f$ is the transmission frequency, $Z_0$ is a characteristic impedance of the antenna, $V_0$ is the free space velocity of a radio wave generated from the slots, $\lambda_0$ is the wave length in free space of the radio wave generated from the slots, and $\theta_{MAX}$ is the maximum angle of said slots relative to the longitudinal axis of said outer conductor.

3. A coaxial slot antenna according to claim 2, wherein corresponding slots belonging to the two rows extend at angles of the same absolute value but in opposite directions, and a desired wave polarization property is obtained by making use of a phase difference of electric power fed thereto.

4. A coaxial slot antenna according to claim 3, wherein the slots belonging to each of the rows extend at varying angles from one end of the row to the other.

5. A coaxial slot antenna according to claim 1, wherein the angle of inclination of the slots is approximately 45 degrees.

6. A coaxial slot antenna according to claim 1, further comprising a parabolic reflector provided on a side of the antenna facing the slots.

7. A coaxial slot antenna according to claim 1, wherein a main beam of the coaxial slot antenna defines an acute angle relative to an output end of the coaxial slot antenna.

8. A coaxial slot antenna according to claim 1, wherein a part of the outer conductor remote from the slots is divided by a longitudinal gap, and an insulator is interposed between the parts of the outer conductor opposing each other across the gap.

9. A coaxial slot antenna according to claim 8, wherein the mutually opposing parts of the outer conductor overlap, and the insulator is interposed between the two overlapped parts of the outer conductor.

10. A coaxial slot antenna according to claim 1, wherein a phase compensation circuit is interposed between the central conductor and the outer conductor.

11. A coaxial slot antenna according to claim 1, further comprising a connector at one end, the connector internally incorporating a transformer for impedance matching.

12. A coaxial slot antenna according to claim 11, wherein the transformer includes a section of the central conductor which has a different diameter from the rest of the central conductor.

13. A coaxial slot antenna according to claim 1, wherein a screen provided with a plurality of inclined slots is placed in front of the coaxial slot antenna for altering the wave polarization property of the coaxial slot antenna.

14. A travelling-wave feeder type coaxial slot antenna array, comprising a plurality of coaxial slot antennas according to claim 1 in a mutually parallel relationship; and a waveguide mixing circuit which is connected to the output ends of the coaxial slot antennas.

15. A coaxial slot antenna array, wherein a pair of coaxial slot antennas according to claim 1, are connected to a waveguide mixing circuit at their output ends, the corresponding slots in the two different coaxial slot antennas extending at angles of the same absolute value but in opposite directions.

* * * * *